US007509069B2

(12) United States Patent
Kim

(10) Patent No.: US 7,509,069 B2
(45) Date of Patent: Mar. 24, 2009

(54) ELECTROPHOTOGRAPHIC IMAGE FORMING APPARATUS FOR PRINTING PHOTOGRAPHIC IMAGE AND METHOD FOR PRINTING PHOTOGRAPHIC IMAGE USING THE SAME

(75) Inventor: Kyung-hwan Kim, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 416 days.

(21) Appl. No.: 11/443,269

(22) Filed: May 31, 2006

(65) Prior Publication Data

US 2007/0020538 A1 Jan. 25, 2007

(30) Foreign Application Priority Data

Jul. 20, 2005 (KR) ..... 10-2005-0065703
Oct. 11, 2005 (KR) ..... 10-2005-0095532

(51) Int. Cl.
*G03G 15/14* (2006.01)

(52) U.S. Cl. ..... 399/107; 399/116; 399/119; 399/121

(58) Field of Classification Search ..... 399/107, 399/116, 119, 121
See application file for complete search history.

(56) References Cited

U.S. PATENT DOCUMENTS

| | | | | |
|---|---|---|---|---|
| 6,681,095 | B1 * | 1/2004 | Tsuda | 399/341 |
| 2002/0085860 | A1 | 7/2002 | Itaya | 399/237 |
| 2002/0167681 | A1 * | 11/2002 | Ide et al. | 358/1.9 |
| 2003/0007814 | A1 * | 1/2003 | Richards | 399/341 |
| 2003/0231912 | A1 * | 12/2003 | Ide | 399/390 |
| 2004/0086694 | A1 * | 5/2004 | Ide | 428/195.1 |
| 2005/0196203 | A1 * | 9/2005 | Tsuda et al. | 399/341 |
| 2005/0214669 | A1 * | 9/2005 | Hayashi et al. | 430/109.4 |

FOREIGN PATENT DOCUMENTS

| | | |
|---|---|---|
| JP | 04-362960 | 12/1992 |
| JP | 11-202583 | 7/1999 |
| JP | 2000-147863 | 5/2000 |
| JP | 2002-082508 | 3/2002 |
| JP | 2002-236392 | 8/2002 |
| JP | 2003-149994 | 5/2003 |
| KR | P1992-22053 | 12/1992 |
| KR | P1999-012969 | 2/1999 |

* cited by examiner

*Primary Examiner*—Hoa V Le
(74) *Attorney, Agent, or Firm*—Roylance, Abrams, Berdo & Goodman, L.L.P.

(57) ABSTRACT

An electrophotographic image forming apparatus for printing a photographic image and a photographic image printing method by using the same are provided. The electrophotographic image forming apparatus for printing a photographic image includes a photosensitive medium having a surface on which a color-image electrostatic latent image and a transparent-image electrostatic latent image are formed by exposure. At least one color developing unit contains a color glossy toner charged with a polarity and develops a color image on the surface of the photosensitive medium by applying the color glossy toner on the color-image electrostatic latent image. A transparent developing unit contains a transparent glossy toner charged with a polarity different from the polarity of the color glossy toner and develops a transparent image on the surface of the photosensitive medium by applying the transparent glossy toner on an external region of the transparent-image electrostatic latent image. The color image and the transparent image are sequentially transferred without overlapping onto an intermediate transfer medium.

9 Claims, 8 Drawing Sheets

ELECTROPHOTOGRAPHIC IMAGE FORMING APPARATUS FOR PRINTING PHOTOGRAPHIC IMAGE AND METHOD FOR PRINTING PHOTOGRAPHIC IMAGE USING THE SAME

CROSS-REFERENCE TO RELATED PATENT APPLICATION

This application claims the benefit under 35 U.S.C. § 119 (a) of Korean Patent Application No. 10-2005-0065703, filed on Jul. 20, 2005, and No. 10-2005-0095532, filed on Oct. 11, 2005, in the Korean Intellectual Property Office, the entire disclosures of which are hereby incorporated by reference.

BACKGROUND OF THE INVENTION

1. Field of the Invention

The present invention relates to an electrophotographic image forming apparatus. More particularly, the present invention relates to an electrophotographic image forming apparatus for printing a photographic image.

2.Description of Related Art

In general, an electrophotographic image forming apparatus is an apparatus for printing a monochrome image or a color image by illuminating a light beam on a surface of a photosensitive medium which is electrically charged with a predetermined electric potential to form an electrostatic latent image, developing the electrostatic latent image with toner, that is, a developing agent, and transferring and fusing the developed image onto a printing medium.

A photographic image developed on a photographic paper is different from a typical print image in that the photographic image is typically glossy. To produce a glossy effect with the electrophotographic image forming apparatus, a so-called glossy toner must be used as a developing agent. However, since the glossy toner is distributed in an image region where the image is formed and is not distributed in a non-image region where an image is not formed, the image region is glossy and the non-image region is not glossy. That it, there is a glossiness difference between the image and non-image regions. Due to this, a photographic image printed by a conventional electrophotographic image forming apparatus feels different than a picture developed on photographic paper.

Accordingly, there is a need for an electrophotographic image forming apparatus that prints a photographic image which is glossy in both image and non-image regions, and a method of printing a photographic image by using the electrophotographic image forming apparatus.

SUMMARY OF THE INVENTION

An aspect of the present invention is to address at least the above problems and/or disadvantages and to provide at least the advantages described below. Accordingly, an aspect of the present invention is to provide an electrophotographic image forming apparatus for printing a photographic image which is capable of printing an image which is glossy in a non-image region as well as an image region of a printing medium and a method of printing a photographic image by using the electrophotographic image forming apparatus.

Another aspect of the present invention is to provide an electrophotographic image forming apparatus for printing a photographic image capable of printing an image wherein the thicknesses of toners distributed in image and non-image regions of a printing medium are uniform and wherein there is no glossiness difference between the image and non-image regions and a method of printing a photographic image by using the electrophotographic image forming apparatus.

In accordance with an aspect of the present invention, an electrophotographic image forming apparatus comprises a photosensitive medium having a surface on which a color-image electrostatic latent image and a transparent-image electrostatic latent image are formed, at least one color developing unit for containing a color glossy toner charged with a polarity and for developing a color image on the surface of the photosensitive medium by applying the color glossy toner on the color-image electrostatic latent image, a transparent developing unit for containing a transparent glossy toner charged with a polarity different from the polarity of the color glossy toner and for developing a transparent image on the surface of the photosensitive medium by applying the transparent glossy toner on an external region of the transparent-image electrostatic latent image, and an intermediate transfer medium on which the color image and the transparent image are sequentially transferred.

The color image and the transparent image may be transferred to the intermediate transfer medium without overlapping.

The electrophotographic image forming apparatus may further comprise a toner charger for charging the transparent glossy toner developed as the transparent image on the surface of the photosensitive medium with a polarity which is the same as the polarity of the color glossy toner.

The toner charger may be a corotron charger which has a corona wire to charge the transparent glossy toner without contacting the toner.

A plurality of color developing units containing different color glossy toners for producing a multi-color image constructed with a plurality of colors may be provided, and a plurality of different color images and the transparent image may be sequentially developed on the surface of the photosensitive medium, and the transparent-image electrostatic latent image may be formed on the surface of the photosensitive medium by exposing an image region constructed by integrating the plurality of different color-image electrostatic latent images.

The plurality of color developing units may be a cyan developing unit for containing a cyan (C) color glossy toner, a magenta developing unit for containing a magenta (M) color glossy toner, a yellow developing unit for containing a yellow (Y) color glossy toner, and a black developing unit for containing a black (K) color glossy toner.

The plurality of color developing units and the transparent developing unit may be mounted on a rotating turret, and the developing units may sequentially face the photosensitive medium by rotation of the turret to supply toners to the surface of the photosensitive medium.

The plurality of color developing units and the transparent developing unit may be disposed on a periphery of the photosensitive medium, and the developing units may sequentially approach the photosensitive medium to supply toners to the surface of the photosensitive medium.

The transparent glossy toner may be developed as the transparent image in a charged state of a positive (+) polarity, and the color glossy toner may be developed as the color image in a charged state of a negative (−) polarity.

In accordance with another aspect of the present invention, an electrophotographic image forming apparatus comprises at least one color developing unit for containing a color glossy toner charged with a polarity and provided with a photosensitive medium having a surface on which a color image is developed by applying the color glossy toner to a color-image electrostatic latent image formed on the photosensitive medium, a transparent developing unit containing a transparent glossy toner charged with a polarity different from the polarity of the color glossy toner and provided with a photosensitive medium having a surface on which a transparent image is developed by applying the transparent glossy toner on an external region of a transparent-image electrostatic latent image formed on the photosensitive medium, and a transferring unit for transferring the color image and the transparent image onto a printing medium.

The color image and the transparent image may be transferred to the printing medium without overlapping.

The electrophotographic image forming apparatus may further comprise a toner charger for charging the transparent glossy toner developed as the transparent image to the surface of the photosensitive medium of the transparent developing unit with a polarity which is the same as the polarity of the color glossy toner.

The toner charger may be a corotron charger which has a corona wire to charge the transparent glossy toner without contacting the toner.

A plurality of the color developing units containing different color glossy toners for producing a multi-color image constructed with a plurality of colors may be provided, and a plurality of different color images and the transparent image may be sequentially developed on the surface of the photosensitive medium, and the transparent-image electrostatic latent image may be formed on the surface of the photosensitive medium by exposing an image region constructed by integrating the plurality of different color-image electrostatic latent images.

The plurality of color developing units may be a cyan developing unit for containing a cyan (C) color glossy toner, a magenta developing unit for containing a magenta (M) color glossy toner, a yellow developing unit for containing a yellow (Y) color glossy toner, and a black developing unit for containing a black (K) color glossy toner.

The transparent glossy toner may be developed as the transparent image in a charged state of a positive (+) polarity, and the color glossy toner may be developed as the color image in a charged state of a negative (−) polarity.

In accordance with a further aspect of the present invention, an electrophotographic image forming method comprises the steps of forming a color-image electrostatic latent image corresponding to a color image on a surface of photosensitive medium, developing the color image by applying a color glossy toner charged with a polarity to the color-image electrostatic latent image, transferring the color image onto an intermediate transfer medium, forming a transparent-image electrostatic latent image on the surface of the photosensitive medium, developing a transparent image by applying a transparent glossy toner charged with a polarity different from the polarity of the color glossy toner onto an external region of the transparent-image electrostatic latent image, transferring the transparent image onto the intermediate transfer medium, and transferring the color image and the transparent image transferred to the intermediate transfer medium onto a printing medium.

The color image and the transparent image may be transferred to the intermediate transfer medium without overlapping.

The electrophotographic image forming method may further comprise a step of charging the transparent glossy toner developed as the transparent image on the surface of the photosensitive medium with a polarity which is the same as the polarity of the color glossy toner.

The steps of forming a color-image electrostatic latent image, developing a color image, and transferring the color image onto an intermediate transfer medium may be repeated with a plurality of different color glossy toners to form a multi-color image on the intermediate transfer medium. The step of forming a transparent-image electrostatic latent image comprises exposing an image region constructed by integrating the different color-image electrostatic latent images.

The different color glossy toners may be a cyan (C) color glossy toner, a magenta (M) color glossy toner, a yellow (Y) color glossy toner, and a black (K) color glossy toner.

The color glossy toner in the color image developing operation may be charged with a negative (−) polarity and the transparent glossy toner in the transparent image developing operation may be charged with apositive (+) polarity.

In accordance with yet another aspect of the present invention, an electrophotographic image forming method comprises the steps of forming a color-image electrostatic latent image corresponding to a color image on a surface of photosensitive medium, developing the color image by applying a color glossy toner charged with a polarity to the color-image electrostatic latent image, forming a transparent-image electrostatic latent image corresponding to a transparent image on the surface of the photosensitive medium, developing a transparent image by applying a transparent glossy toner charged with a polarity different from the polarity of the color glossy toner on an external region of the transparent-image electrostatic latent image, and transferring the color image and the transparent image onto a printing medium.

The color image and the transparent image may be transferred to the printing medium without overlapping.

The electrophotographic image forming method may further comprise the step of charging the transparent glossy toner developed as the transparent image on the surface of the photosensitive medium with a polarity which is the same as the polarity of the color glossy toner.

The steps of forming a color-image electrostatic latent image, developing a color image, and transferring the color image onto an intermediate transfer medium may be repeated with a plurality of different color glossy toners to form a multi-color image on the intermediate transfer medium. The step of forming a transparent-image electrostatic latent image comprises exposing an image region constructed by integrating the different color-image electrostatic latent images.

The different color glossy toners may be a cyan (C) color glossy toner, a magenta (M) color glossy toner, a yellow (Y) color glossy toner, and a black (K) color glossy toner.

The color glossy toner in the color image developing operation may be charged with a negative (−) polarity and the transparent glossy toner in the transparent image developing operation may be charged with a positive (+) polarity.

In accordance with a further aspect of the present invention, an electrophotographic image forming apparatus comprises a photosensitive medium comprising a surface on which a color-image electrostatic latent image and a transparent-image electrostatic latent image are formed, at least one color developing unit for containing a color glossy toner charged with a polarity and for developing a color image on the surface of the photosensitive medium by applying the color glossy toner to the color-image electrostatic latent image, a transparent developing unit for containing a transparent glossy toner charged with a polarity different from the polarity of the color glossy toner and for developing a transparent image on the surface of the photosensitive medium by applying the transparent glossy toner on an external region of the transparent-image electrostatic latent image, and an intermediate transfer medium on which the color image and the transparent image are sequentially transferred. The transparent image transferred to the intermediate transfer medium is formed on a non-image region outside the color image without overlapping with the color image transferred to the intermediate transfer medium.

The electrophotographic image forming apparatus may further comprise a plurality of the color developing units containing different color glossy toners for producing a multi-color image constructed with a plurality of colors. A plurality of different color images and the transparent image may be sequentially developed on the surface of the photosensitive medium, and the transparent-image electrostatic latent image may be formed on the surface of the photosensitive medium by exposing an image region constructed by integrating the plurality of different color-image electrostatic latent images.

The electrophotographic image forming apparatus may further comprise a plurality of the color developing units containing different color glossy toners for producing a multi-color image constructed with a plurality of colors. A plurality of different color images and the transparent image may be sequentially developed on the surface of the photosensitive medium, and the transparent-image electrostatic latent image may be formed on the surface of the photosensitive medium by exposing a non-image region constructed by subtracting an image region constructed by integrating the plurality of different color-image electrostatic latent images from an exposure-available region of the photosensitive medium.

The plurality of color developing units may comprise a cyan developing unit for containing a cyan (C) color glossy toner, a magenta developing unit for containing a magenta (M) color glossy toner, a yellow developing unit for containing a yellow (Y) color glossy toner, and a black developing unit for containing a black (K) color glossy toner.

The plurality of color developing units and the transparent developing unit may be mounted on a rotating turret and the developing units may sequentially face the photosensitive medium by rotation of the turret to supply toners on the surface of the photosensitive medium.

The plurality of color developing units and the transparent developing unit may be disposed on a periphery of the photosensitive medium, and the developing units may sequentially approach the photosensitive medium to supply toners on the surface of the photosensitive medium.

According to another aspect of the present invention, an electrophotographic image forming apparatus comprises at least one color developing unit for containing a color glossy toner charged with a polarity and provided with a photosensitive medium having a surface on which a color image is developed by applying the color glossy toner on a color-image electrostatic latent image formed by exposure, a transparent developing unit for containing a transparent glossy toner charged with a polarity equal to the polarity of the color glossy toner and provided with a photosensitive medium having a surface on which a transparent image is developed by applying the transparent glossy toner to a transparent-image electrostatic latent image formed by exposure, and a transferring unit for transferring the color image and the transparent image onto a printing medium. The transparent image may be formed on a non-image region outside the color image without overlapping with the color image transferred to the printing medium.

The electrophotographic image forming apparatus may further comprise a plurality of the color developing units containing different color glossy toners for producing a multi-color image constructed with a plurality of colors. A plurality of different color images and the transparent image may be sequentially developed on the surface of the photosensitive medium, and the transparent-image electrostatic latent image may be formed on the surface of the photosensitive medium by exposing a non-image region constructed by subtracting an image region constructed by integrating the plurality of different color-image electrostatic latent images from an exposure-available region of the photosensitive medium.

The plurality of color developing units may comprise a cyan developing unit for containing a cyan (C) color glossy toner, a magenta developing unit for containing a magenta (M) color glossy toner, a yellow developing unit for containing a yellow (Y) color glossy toner, and a black developing unit for containing a black (K) color glossy toner.

According to another aspect of the present invention, an electrophotographic image forming method comprises the steps of forming a color-image electrostatic latent image corresponding to a color image on a surface of photosensitive medium, developing the color image by applying a color glossy toner charged with a polarity on the color-image electrostatic latent image, transferring the color image onto an intermediate transfer medium, forming a transparent-image electrostatic latent image on the surface of the photosensitive medium, developing a transparent image by applying a transparent glossy toner charged with a polarity equal to the polarity of the color glossy toner on the transparent-image electrostatic latent image, transferring the transparent image onto the intermediate transfer medium, and transferring the color image and the transparent image transferred to the intermediate transfer medium onto a printing medium. The transparent image transferred to the intermediate transfer medium may be formed on a non-image region outside the color image without overlapping with the color image transferred to the intermediate transfer medium.

The steps of forming a color-image electrostatic latent image, developing a color image, and transferring the color image onto an intermediate transfer medium may be repeated with a plurality of different color glossy toners to form a multi-color image on the intermediate transfer medium. The step of forming a transparent-image electrostatic latent image may comprise the step of exposing a non-image region constructed by subtracting an image region constructed by integrating the plurality of different color-image electrostatic latent images from an exposure-available region of the photosensitive medium.

The different color glossy toners may be a cyan (C) color glossy toner, a magenta (M) color glossy toner, a yellow (Y) color glossy toner, and a black (K) color glossy toner.

According to another aspect of the present invention, an electrophotographic image forming method comprises the steps of forming a color-image electrostatic latent image corresponding to a color image on a surface of photosensitive medium, developing the color image by applying a color glossy toner charged with a polarity to the color-image electrostatic latent image, forming a transparent-image electrostatic latent image for forming a transparent image on the surface of the photosensitive medium, developing a transparent image by applying a transparent glossy toner charged with a polarity equal to the polarity of the color glossy toner on the transparent-image electrostatic latent image, and transferring the color image and the transparent image onto a printing medium. The transparent image transferred to the printing medium may be formed on a non-image region outside the color image without overlapping with the color image transferred to the printing medium.

The steps of forming a color-image electrostatic latent image, developing a color image, and transferring the color image onto an intermediate transfer medium may be repeated with a plurality of different color glossy toners to form a multi-color image on the intermediate transfer medium. The step of forming a transparent-image electrostatic latent image may comprise the step of exposing a non-image region constructed by subtracting an image region constructed by integrating the plurality of different color-image electrostatic latent images from an exposure-available region of the photosensitive medium.

The different color glossy toners may be a cyan (C) color glossy toner, a magenta (M) color glossy toner, a yellow (Y) color glossy toner, and a black (K) color glossy toner.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF EXEMPLARY EMDODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

An electrophotographic image forming apparatus for printing a photographic image according to an exemplary embodiment of the present invention and a photographic image printing method using the same will now be described in detail with reference to the accompanying drawings.

Figure 1:
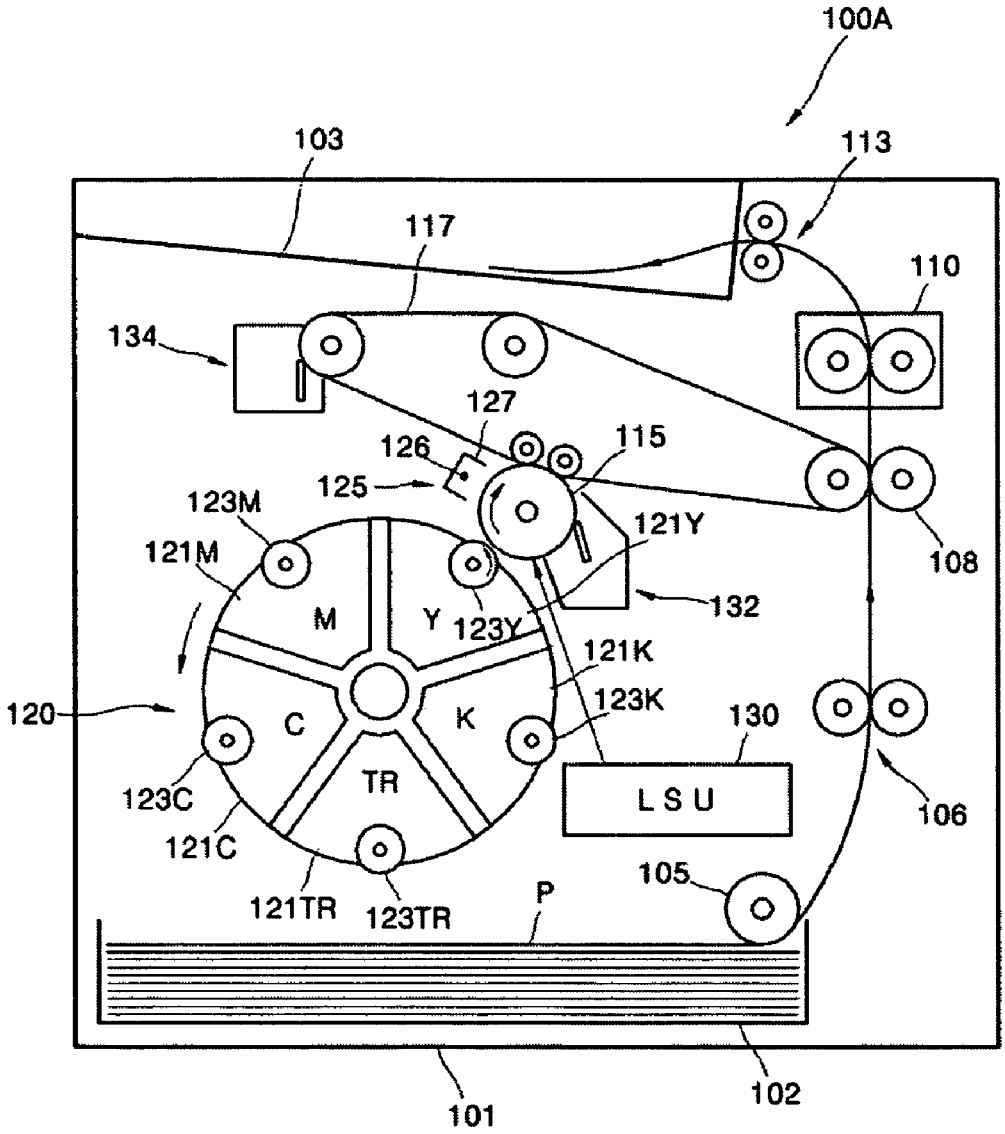
FIG. 1 is a cross sectional view of an electrophotographic image forming apparatus according to a first exemplary embodiment of the present invention.

FIG. 1 is a cross sectional view of an electrophotographic image forming apparatus according to a first exemplary embodiment of the present invention;

Referring to FIG. 1, the electrophotographic image forming apparatus 100A according to the first exemplary embodiment of the present invention is a multi-path type image forming apparatus where an image is transferred to a printing medium P through an intermediate transfer medium 117. The image forming apparatus 100A includes a turret 120 on which five developing units 121 are mounted, a cylindrical photosensitive medium 115, a light scanning unit 130, the intermediate transfer medium 117, and a transfer roller 108 within a case 101 of the electrophotographic image forming apparatus 100A.

The photosensitive medium 115 is a medium constructed by forming a photosensitive layer made of a photo-conductive material disposed on an outer surface of a metal drum by deposition or the like. The light scanning unit 130 is disposed under the photosensitive medium 115 and scans a light beam corresponding to a desired image on the photosensitive medium 115. An electrostatic latent image is formed on a surface of the photosensitive medium 115 where exposed to the light beam. A laser scanning unit (LSU) using a laser diode is generally employed as the light scanning unit 130.

The five developing units 121C, 121M, 121Y, 121K, and 121TR mounted on the turret 120 contain cyan (C), magenta (M), yellow (Y), black (K) color, and non-colored transparent solid powder toners, respectively. To produce glossy photographic images, the glossy toners are used. A glossy toner can be made by adding a typical colorant, an internal additive material, an outer additive material, and wax to a binding resin. The wax may be a natural wax, a paraffin wax, an ester wax, or the like. As the amount of added wax increases, the glossiness of the toner increases. The wax can be added up to about 5% of the total weight of the toner. In an exemplary embodiment, the wax is about 3% of the total weight of the toner.

The glossy toner contained in the transparent developing unit 121TR is non-colored and transparent. Therefore, unlike typical toners, no colorant is added. In an exemplary embodiment, the color glossy toners are charged with a negative (−) polarity when the color glossy toners are contained in the respective color developing units 121C, 121M, 121Y, and 121K. Unlike the color glossy toners, however, the transparent glossy toner is charged with a positive (+) polarity when the transparent glossy toner is contained in the transparent developing unit 121TR. To have a positive (+) polarity, the transparent glossy toner may be made by adding a wax of an acid value not exceeding 10 to a polyester binding resin of an acid value not exceeding 10. At least one of silica, a silica titan oxide, and an aluminum oxide which have a BET surface area of 150 $m^2/g$ or more may be added as an outer additive material to the transparent glossy toner.

The four color developing units 121C, 121M, 121Y, and 121K and the transparent developing unit 121TR include respective developing rollers 123C, 123M, 123Y, 123K, and 123TR which apply the toners contained therein to the photosensitive medium 115 to develop respective color images and a transparent image. The turret 120 rotates in a counter-clockwise direction and enables the developing units 121C, 121M, 121Y, 121K, and 121TR to sequentially face the photosensitive medium 115 and apply toner to the photosensitive medium 115 to develop the color images and the transparent image.

Although not shown, the developing units 121C, 121M, 121Y, 121K, and 121TR are provided with toner applying rollers for applying the toners to the developing rollers 123C,

123M, 123Y, 123K, and 123TR, doctor blades for controlling the amounts of the toners applied to the developing roller 123C, 123M, 123Y, 123K, and 123TR, and agitators for agitating the toners so that they do not congeal.

A toner charger 125 which charges the transparent glossy toner developed as the transparent image on an outer surface of the photosensitive medium 115 with a negative (−) polarity which is the same as the polarity of the color glossy toners is disposed on a periphery of the photosensitive medium 115. The toner charger 125 may be a corotron charge constructed with a corona wire 126 extending in a longitudinal direction of the photosensitive medium 115 and a conductive member 127 surrounding the corona wire 126. Corotron chargers are a type of chargers for charging the photosensitive medium 115 with a predetermined potential and are well known to those of ordinarily skill in the art.

If a voltage is applied to the corona wire 126, gas molecules in the vicinity of the corona wire 126 are ionized, and then, the ions move to the photosensitive medium 115 which is not shielded with the conductive member 127. The moving ions are adsorbed by the transparent glossy toner on the surface of the photosensitive medium 115, so that the transparent glossy toner can be charged with a negative (−) polarity. The toner charger 125 may charge the toner with a negative (−) polarity without contacting the transparent glossy toner attached on the surface of the photosensitive medium 115, and the transparent glossy toner charged with the negative (−) polarity may be transferred to the intermediate transfer medium 117 and the printing medium P, similar to the color glossy toners. In an exemplary embodiment, a voltage ranging from 3 kV to 5 kV is applied to the corona wire 126.

The intermediate transfer medium 117 is a transfer belt which is supported by a plurality of supporting rollers. The intermediate transfer belt circulates and a cyan (C) image, a magenta (M) image, a yellow (Y) image, a black (K) image, and a transparent image are sequentially transferred to the intermediate transfer medium 117 to form a multi-color image. In the multi-color image, both the transparent non-image region as well as the image region where characters, symbols, designs, or the like are represented with predetermined colors are glossy. The length of the intermediate transfer medium 117 is equal to or greater than the length of the printing medium P on which the multi-color image is finally transferred.

The transfer roller 108 faces the intermediate transfer medium 117. While the toners are transferred to the intermediate transfer medium 117, the transfer roller 108 is separated from the intermediate transfer medium 117. Once the toner images are formed on the intermediate transfer medium 117, the transfer roller 108 contacts the intermediate transfer medium 117 to transfer the toner images onto the printing medium P.

A fusing unit 110 fixes the toner image transferred to the printing medium P onto the printing medium P. The fusing unit 110 includes a pair of rollers which are engaged with each other to rotate and a heater for heating the printing medium P. If the printing medium P on which the toner images are transferred passes through the fusing unit 110, the toner images are fixed onto the printing medium P by heat and pressure, so that image printing is completed.

In a lower portion of the image forming apparatus 100A, a paper-feeding cassette 102 in which the printing medium P is contained is detachably inserted in the case 101. The printing medium P contained in the paper-feeding cassette 102 is picked up one by one by a pickup roller 105. A paper-feeding roller 106 feeds the printing medium P picked up by the pickup roller 105 to the transfer roller 108. An ejecting roller 113 ejects the printing medium P from the case 101. The ejected paper is ejected onto a discharge tray 103 disposed on an upper surface of the case 101.

In addition, the image forming apparatus 100A includes a first waste toner cleaner 132 for scraping and removing waste toner which is not transferred to the intermediate transfer medium 117 from the photosensitive medium 115. A second waste toner cleaner 134 scrapes and removes waste toner which is not transferred to the printing medium P from the intermediate transfer medium 117.

A photographic image printing method using the electrophotographic image forming apparatus 100A having the aforementioned construction will now be described.

Firstly, if a turret 120 rotates to enable the cyan (C) developing unit 121C to face the photosensitive medium 11, the light scanning unit 130 scans a light beam corresponding to the cyan (C) color image information to the photosensitive medium 115, so that an electrostatic latent image corresponding to the cyan (C) color image is formed on the surface of the photosensitive medium 115. The cyan (C) glossy toner having a negative (−) polarity contained in the cyan developing unit 121C is attached to the electrostatic latent image, so that the cyan (C) color glossy toner image is developed on the photosensitive medium 115, and the toner image is transferred to the intermediate transfer medium 117.

After the cyan (C) color toner image is formed on the intermediate transfer medium 117, the turret 120 rotates by 72° in a counterclockwise direction to enable the magenta developing unit 121M to face the photosensitive medium, and the light scanning unit 130 scans a light beam corresponding to the magenta (M) color image information on the photosensitive medium 115, so that a magenta (M) color-image electrostatic latent image is formed. Therefore, the magenta (M) glossy toner having a negative (−) polarity contained in the magenta developing unit 121M is attached to the electrostatic latent image, so that the magenta (M) color toner image is developed on the photosensitive medium 115, and the toner image is transferred to the intermediate transfer medium 117.

At this time, by appropriately setting the scanning timing of the light beam scanned from the light scanning unit 130 based on the circulating speed of the intermediate transfer medium 117, a distal end of the cyan (C) color toner image previously formed on the intermediate transfer medium 117 and a distal end of the magenta (M) color toner image starting to be transferred from the photosensitive medium 115 to the intermediate transfer medium 117 are accurately aligned with each other.

These operations are repeated for the yellow (Y) and black (K), so that the cyan (C), magenta (M), yellow (Y), and black (K) color toner images are integrated on the intermediate transfer medium 117.

Figure 8:
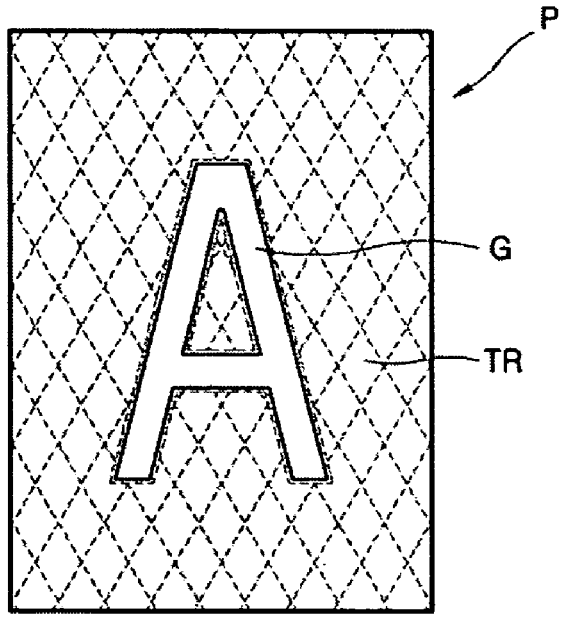
FIG. 8 is a plan view of an example of a printing medium on which an image is printed with an electrophotographic image forming apparatus according to exemplary embodiments of the present invention.

After the black (K) color toner image is transferred to the intermediate transfer medium 117, the turret 120 rotates by 72° in a counterclockwise direction to enable the transparent developing unit 121TR to face the photosensitive medium 115. The light scanning unit 130 generates an electrostatic latent image for forming the transparent image on the surface of the photosensitive medium 115. The transparent-image electrostatic latent image is formed by exposing an image region constructed by integrating the cyan (C), magenta (M), yellow (Y), and black (K) color-image electrostatic latent images. The light scanning unit 130 scans the light beam based on the image information constructed by integrating the C, M, Y, and K color image information. Referring to FIG. 8, for example, the image region to which the light beam is scanned is an inner boundary region of a design "A", and the non-image region is an outer boundary region of the design "A".

The transparent (TR) glossy toner having a positive (+) polarity contained in the transparent developing unit 121TR is not attached to the transparent-image electrostatic latent image having a relatively positive (+) polarity. Instead, the toner is attached to the outer region of the transparent-image electrostatic latent image having a relatively negative (−) polarity, so that the glossy transparent toner image is developed on the photosensitive medium 115.

The transparent toner image is changed from the positive (−) polarity into a negative (−) polarity by the toner charger 125 and transferred to the intermediate transfer medium 117. At this time, in order not to overlap the boundary portions of the color toner images previously formed on the intermediate transfer medium 117 with the boundary portion of the transparent toner image, the scanning timing of the light beam scanned from the light scanning unit 130 must be appropriately set based on the circulating speed of the intermediate transfer medium 117.

The toner image formed by integrating the C, M, Y, and K color toner images and the transparent toner image is finally transferred to the printing medium P. More specifically, the printing medium P contained in the paper-feeding cassette 102 is picked up by the pickup roller 105, and fed by the paper-feeding roller 106 to pass between the transfer roller 108 and the intermediate transfer medium 117. At this time, by a transfer bias applied to the transfer roller 108, the toner image on the intermediate transfer medium 117 is transferred to the printing medium P. The toner image transferred to the printing medium P passes through the fusing unit 110 and is fixed onto the printing medium P by heat and pressure to form a photographic image. The printing medium P on which the photographic image is printed is ejected by the ejecting roller 113 onto the discharge tray 103.

Figure 2:
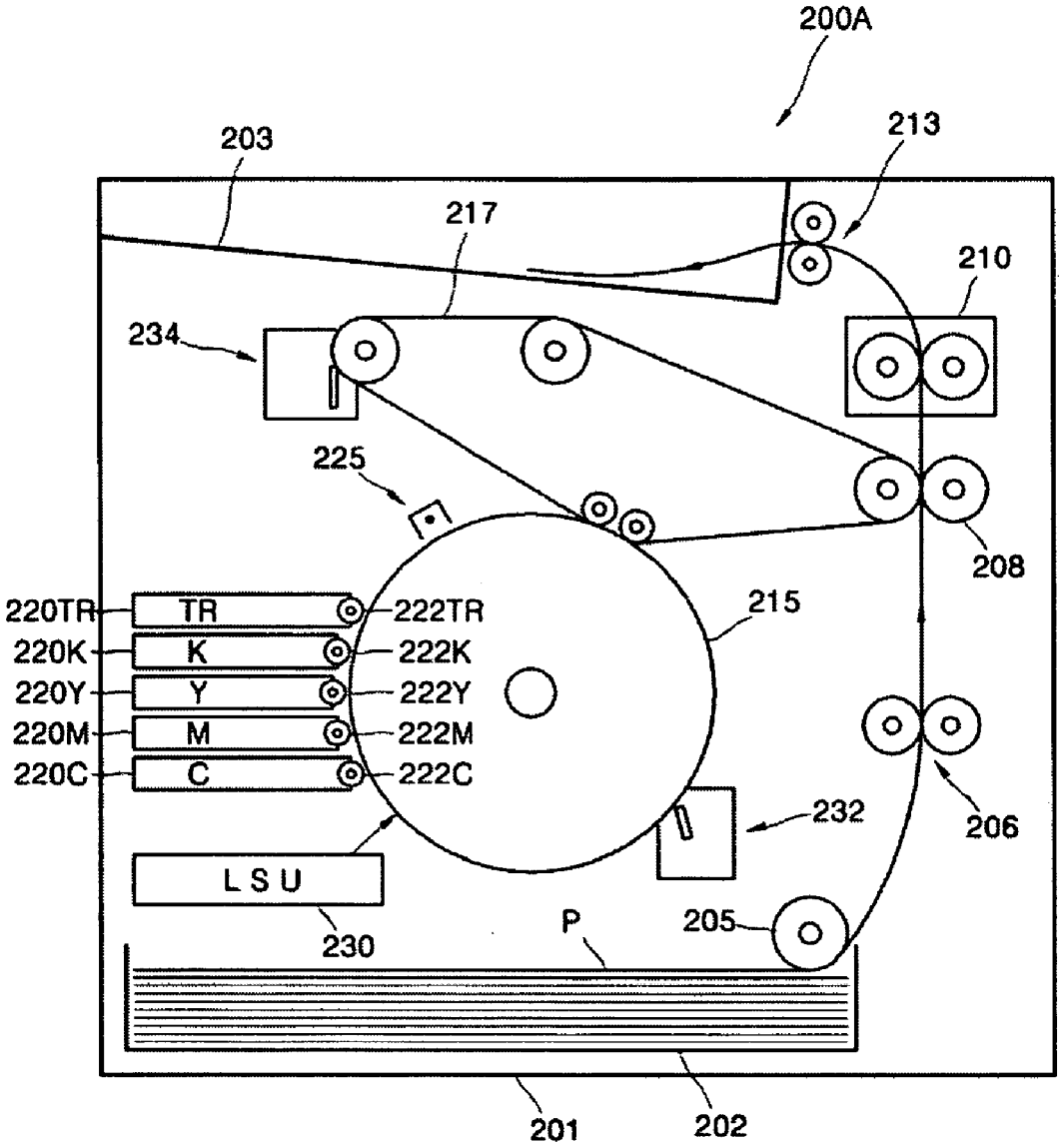
FIG. 2 is a cross sectional view of an electrophotographic image forming apparatus according to a second exemplary embodiment of the present invention.

FIG. 2 is a cross sectional view of an electrophotographic image forming apparatus 200A according to a second exemplary embodiment of the present invention.

Referring to FIG. 2, similar to the first exemplary embodiment, the electrophotographic image forming apparatus 200A according to the second exemplary embodiment of the present invention is a multi-path type image forming apparatus and includes a cylindrical photosensitive medium 215, developing units 220C, 220M, 220Y, 220K, and 220TR stacked on a periphery of the photosensitive medium 215, a light scanning units 230, an intermediate transfer medium 217, and a transfer roller 208 within a case 201 of the electrophotographic image forming apparatus 200A.

The photosensitive medium 215 is a medium constructed with a photosensitive layer made of a photo-conductive material disposed on an outer surface of a metal drum by deposition or the like. The light scanning unit 230 is disposed under the photosensitive medium 215 and scans a light beam corresponding to image information on the photosensitive medium 215. An electrostatic latent image is formed on a surface of the photosensitive medium 215 exposed to the light beam.

The five developing units 221C, 221M, 221Y, 221K, and 221TR contain cyan (C), magenta (M), yellow (Y), black (K) color, and non-colored transparent solid powder toners, respectively. To produce a glossy photographic image, glossy toners are used. In addition, the color glossy toners are charged with a negative (−) polarity, and the transparent glossy toner is charged with a positive (+) polarity. Since the toners in the second exemplary embodiment are the same as those of the first exemplary embodiment, a detailed description is not repeated.

The four color developing units 220C, 220M, 220Y, and 220K and the transparent developing unit 220TR include developing roller 222C, 222M, 222Y, 222K, and 222TR for applying toners contained therein to the photosensitive medium 215 to develop color images and the transparent image, respectively. The developing units 220C, 220M, 220Y, 220K, and 220TR sequentially approach the photosensitive medium 215 and apply toners thereto to develop the C, M, Y, and K color toner images and the transparent toner image on the outer surface of the photosensitive medium 215. Although not shown, similar to the first exemplary embodiment, an applying roller, a doctor blade, and an agitator are provided to each of the developing units 220C, 220M, 220Y, 220K, and 220TR.

A toner charger 225 which charges the transparent glossy toner developed as the transparent image on the outer surface of the photosensitive medium 215 with a negative (−) polarity which is the same as that of the color glossy toner is disposed on a periphery of the photosensitive medium 215. Since the toner charger 225 has the same construction as the toner charger 125 (see FIG. 1) described in the first exemplary embodiment, a detailed description is not repeated.

The intermediate transfer medium 217 is a transfer belt supported by a plurality of supporting rollers. The color toner images and transparent toner image are transferred onto the intermediate transfer medium 217. The length of the intermediate transfer medium 217 is equal to or greater than that of the printing medium P.

Transfer roller 208 faces the intermediate transfer medium 217. While the toners are transferred to the intermediate transfer medium 217, the transfer roller 208 is separated from the intermediate transfer medium 217. Once the toner images are formed on the intermediate transfer medium 217, the transfer roller 208 contacts the intermediate transfer medium 217 to transfer the toner images onto the printing medium P.

In addition, similar to the image forming apparatus 100A (see FIG. 1) in the first exemplary embodiment, the image forming apparatus 200A includes a fusing unit 210 for fixing the toner images transferred to the printing medium P on the printing medium P, a paper-feeding cassette 202 in which the printing medium P is contained, a pickup roller 205 for picking up the printing medium P contained in the paper-feeding cassette 202 one by one, a paper-feeding roller 206 for feeding the printing medium P picked up by the pickup roller 205 to the transfer roller 208, an ejecting roller 213 for ejecting the printing medium P from the case 201, and a discharge tray 203 for receiving the printing medium P ejected by the ejecting roller 213. In addition, the image forming apparatus 200A includes a first waste toner cleaner 232 for scraping and removing waste toner which is not transferred to the intermediate transfer medium 217 from the photosensitive medium 215 and a second waste toner cleaner 234 for scraping and removing waste toner which is not transferred to the printing medium P from the intermediate transfer medium 217.

A photographic image printing method using the electrophotographic image forming apparatus 200A according to the second exemplary embodiment will now be described.

Firstly, the cyan developing unit 220C approaches the photosensitive medium 215, and the light scanning unit 230 scans a light beam corresponding to the cyan (C) color image information to the photosensitive medium 215, so that an electrostatic latent image corresponding to the cyan (C) color image is formed on the surface of the photosensitive medium 215. The cyan (C) glossy toner having a negative (−) polarity contained in the cyan developing unit 220C is attached to the electrostatic latent image, so that the cyan (C) color glossy toner image is developed on the photosensitive medium 215, and the toner image is transferred to the intermediate transfer medium 217.

Once the cyan (C) color toner image is formed on intermediate transfer medium 217, the cyan developing unit 220C is withdrawn, and the magenta developing unit 220M is extended toward the photosensitive medium 215. The light scanning units 230 scans a light beam corresponding to the magenta (M) color image information onto the photosensitive medium 215 to form an electrostatic latent image corresponding to the magenta (M) color image. The magenta (M) glossy toner having a negative (−) polarity contained in the magenta developing unit 220M is attached to the electrostatic latent image, so that the magenta (M) color toner image is developed on the photosensitive medium 215, and the toner image is transferred to the intermediate transfer medium 217.

At this time, by appropriately setting the scanning timing of the light beam scanned from the light scanning unit 230 based on the circulating speed of the intermediate transfer medium 217, a distal end of the cyan (C) color toner image previously formed on the intermediate transfer medium 217 and a distal end of the magnet (M) color toner image starting to be transferred from the photosensitive medium 215 to the intermediate transfer medium 217 are accurately aligned with each other.

These operations are repeated for the yellow (Y) and black (K) images, so that the cyan (C), magenta (M), yellow (Y), and black (K) color toner images are integrated on the intermediate transfer medium 217.

After the black (K) color toner image is transferred to the intermediate transfer medium 217, the black developing unit 220K is withdrawn, and the transparent developing unit 220TR is extended toward the photosensitive medium 215. By the light beam scanned from the light scanning units 230, an electrostatic latent image for forming the transparent image is formed on the surface of the photosensitive medium 215. The transparent-image electrostatic latent image is formed by exposing an image region constructed by integrating the cyan (C), magenta (M), yellow (Y), and black (K) color-image electrostatic latent images. The light scanning unit 230 scans the light beam based on the image information constructed by integrating the C, M, Y, and K color image information.

The transparent (TR) glossy toner having a positive (+) polarity contained in the transparent developing unit 220TR is not attached to the transparent-image electrostatic latent image having a relatively positive (+) polarity. Instead, the toner is attached to the outer region of the transparent-image electrostatic latent image having a relatively negative (−) polarity, so that the glossy transparent toner image is developed on the photosensitive medium 215.

The transparent toner image is changed from the positive (−) polarity into a negative (−) polarity by the toner charger 225 and transferred to the intermediate transfer medium 117. At this time, in order not to overlap the boundary portions of the color toner images previously formed on the intermediate transfer medium 217 with the boundary portion of the transparent toner image, the scanning timing of the light beam scanned from the light scanning unit 230 must be appropriately set based on the circulating speed of the intermediate transfer medium 217.

The toner image formed by integrating the C, M, Y, and K color toner images and the transparent toner image is finally transferred to the printing medium P which passes between the transfer roller 208 and the intermediate transfer medium 217 and fixed onto the printing medium P by the fusing unit 210, so that a photographic image is formed. The printing medium P on which the photographic image is printed is ejected by the ejecting roller 213 onto the discharge tray 203.

Figure 3:
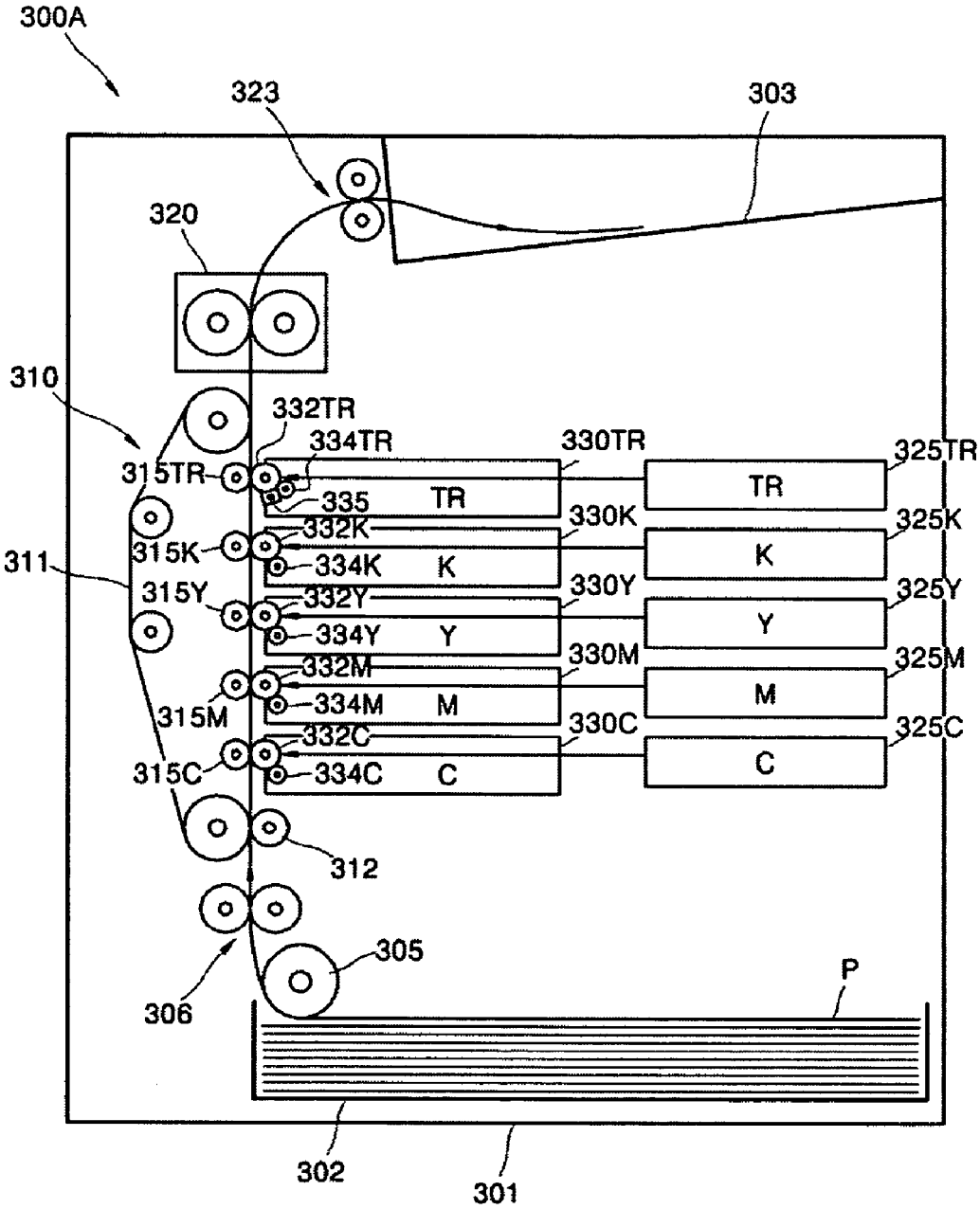
FIG. 3 is a cross sectional view of an electrophotographic image forming apparatus according to a third exemplary embodiment of the present invention.

FIG. 3 is a cross sectional view of an electrophotographic image forming apparatus 300A according to a third exemplary embodiment of the present invention.

Referring to FIG. 3, the electrophotographic image forming apparatus 300A is a single-path type image forming apparatus where an image is directly transferred to a printing medium P and includes five developing units 330C, 330M, 330Y, 330K, and 330TR, five light scanning units 325C, 325M, 325Y, 325K, and 325TR, and a transferring unit 310 within a case 301 of the electrophotographic image forming apparatus 300A.

The five developing units 330C, 330M, 330Y, 330K, and 330TR contain cyan (C), magenta (M), yellow (Y), black (K) color, and non-colored transparent solid powder toners, respectively. To produce a glossy photographic image, glossy toners are used. The four types of color glossy toners are charged with a negative (−) polarity, and the transparent glossy toner is charged with a positive (+) polarity. Since the toners in the third exemplary embodiment are the same as those of the first exemplary embodiment, a detailed description is not repeated.

The four color developing units 330C, 330M, 330Y, and 330K and the transparent developing unit 330TR include photosensitive media 332C, 332M, 332Y, 332K, and 332TR and developing rollers 334C, 334M, 334Y, 334K, and 334TR. The developing rollers 334C, 334M, 334Y, 334K, and 334TR apply toners contained in the developing units 330C, 330M, 330Y, 330K, and 330TR to the photosensitive media 332C, 332M, 332Y, 332K, and 332TR to form C, M, Y, and K color images and a transparent image on surfaces thereof. Although not shown, similar to the first exemplary embodiment, an applying roller, a doctor blade, and an agitator are provided to each of the developing units 330C, 330M, 330Y, 330K, and 330TR.

On the other hand, a toner charger 335 which charges the transparent glossy toner developed as the transparent image on an outer surface of the photosensitive medium 332TR with a negative (−) polarity which is the same as that of the color glossy toner is disposed on a periphery of the photosensitive medium 332TR of the transparent developing unit 330TR. Sine the toner charger 335 has the same construction as the toner charger 125 (see FIG. 1) described in the first exemplary embodiment, a detailed description is not repeated.

Five light scanning units 325C, 325M, 325Y, 325K, and 325TR corresponding to the five developing units 330C, 330M, 330Y, 330K, and 330TR scan light beams corresponding to image information to the photosensitive media 332C, 332M, 332Y, 332K, and 332TR, respectively. Electrostatic latent images are formed on surfaces of the photosensitive media 332C, 332M, 332Y, 332K, and 332TR exposed to the light beams.

The transferring unit 310 includes a conveying belt 311 which is supported by a plurality of supporting rollers and an attaching roller 312. The conveying belt 311 circulates upwards and downwards and the attaching roller 312 induces static electricity to attach the printing medium P to the conveying belt 311 so that the printing medium is transferred upwardly. In addition, the transferring unit 310 includes five transfer rollers 315C, 315M, 315Y, 315K, and 315TR which face the photosensitive media 332C, 332M, 332Y, 332K, and 332TR of the developing units 330C, 330M, 330Y, 330K, and 330TR with the conveying belt 311 interposed therebetween.

In addition, similar to the image forming apparatus 100A (see FIG. 1), the image forming apparatus 300A includes a fusing unit 320 for fixing the toner images transferred to the printing medium P on the printing medium P by heat and pressure, a paper-feeding cassette 302 in which the printing medium is contained, a pickup roller 305 for picking up the printing medium P contained in the paper-feeding cassette 302 one by one, a paper-feeding roller 306 for feeding the picked-up printing medium P, an ejecting roller 323 for ejecting the printing medium P on which an image is printed from the case 301, and a discharge tray 303 for receiving the printing medium P ejected from the case 301.

A photographic image printing method using the electrophotographic image forming apparatus 300A having the aforementioned construction will now be described.

The five light scanning units 325C, 325M, 325Y, 325K, and 325TR scan light beams to the photosensitive media 332C, 332M, 332Y, 332K, and 332TR of the developing units 330C, 330M, 330Y, 330K, and 330TR, so that electrostatic latent images are formed on the photosensitive media 332C, 332M, 332Y, 332K, and 332TR. More specifically, the light scanning units 325C, 325M, 325Y, and 325K corresponding to the color developing units 330C, 330M, 330Y, and 330K scan light beams corresponding to C, M, Y, and K color image information to form C, M, Y, and K color-image electrostatic latent images on surfaces of the photosensitive media 332C, 332M, 332Y, and 332K. The light scanning unit 325TR corresponding to the transparent developing unit 330TR scans a light beam based on image information constructed by integrating the C, M, Y, and K color image information, so that the transparent-image electrostatic latent image is formed on the photosensitive medium 332TR by exposing the image region constructed by integrating the C, M, Y, and K color-image electrostatic latent image.

The color glossy toners having a negative (−) polarity contained in the color developing units 330C, 330M, 330Y, and 330K are attached on the C, M, Y, and K color-image electrostatic latent images. Then, the glossy cyan (C), magenta (M), yellow (Y), black (K) color toner images are developed on the photosensitive media 332C, 332M, 332Y, and 332K. On the other hand, the transparent (TR) glossy toner having a positive (+) polarity contained in the transparent developing unit 330TR is not attached to the transparent-image electrostatic latent image having a relatively positive (+) polarity. Instead, the toner is attached to the outer region of the transparent-image electrostatic latent image having a relatively negative (−) polarity, so that the glossy transparent toner image is developed on the surface of the photosensitive medium 332TR. The transparent toner image is charged from a positive (+) polarity into a negative (−) polarity by the toner charger 335.

The printing medium P is picked up from the paper-feeding cassette 302 by the pickup roller 305 and fed by the paper-feeding roller 306. Then, due to static electricity induced by the attaching roller 312, the printing medium P is attached on the conveying belt 311 and is conveyed at the same speed as the circulating speed of the conveying belt 311.

As the printing medium P attached on the conveying belt 311 is conveyed upwardly, a transfer bias is applied to the transfer rollers 315C, 315M, 315Y, 315K, and 315TR, so that the C, M, Y, and K color toner images and the transparent toner image are sequentially transferred to the printing medium P. The scanning timing of the light beams scanned from the light scanning units 325TR is set appropriately based on the circulating speed of the conveying belt 311 so that the color toner images and the transparent toner image are registered.

The toner image constructed by integrating the C, M, Y, and K color toner images and the transparent toner image is fixed onto the printing medium P by the fusing unit 320, so that the photographic image is formed. The printing image P on which the photographic image is printed is ejected by the ejecting roller 323 onto the discharge tray 303.

Figure 4:
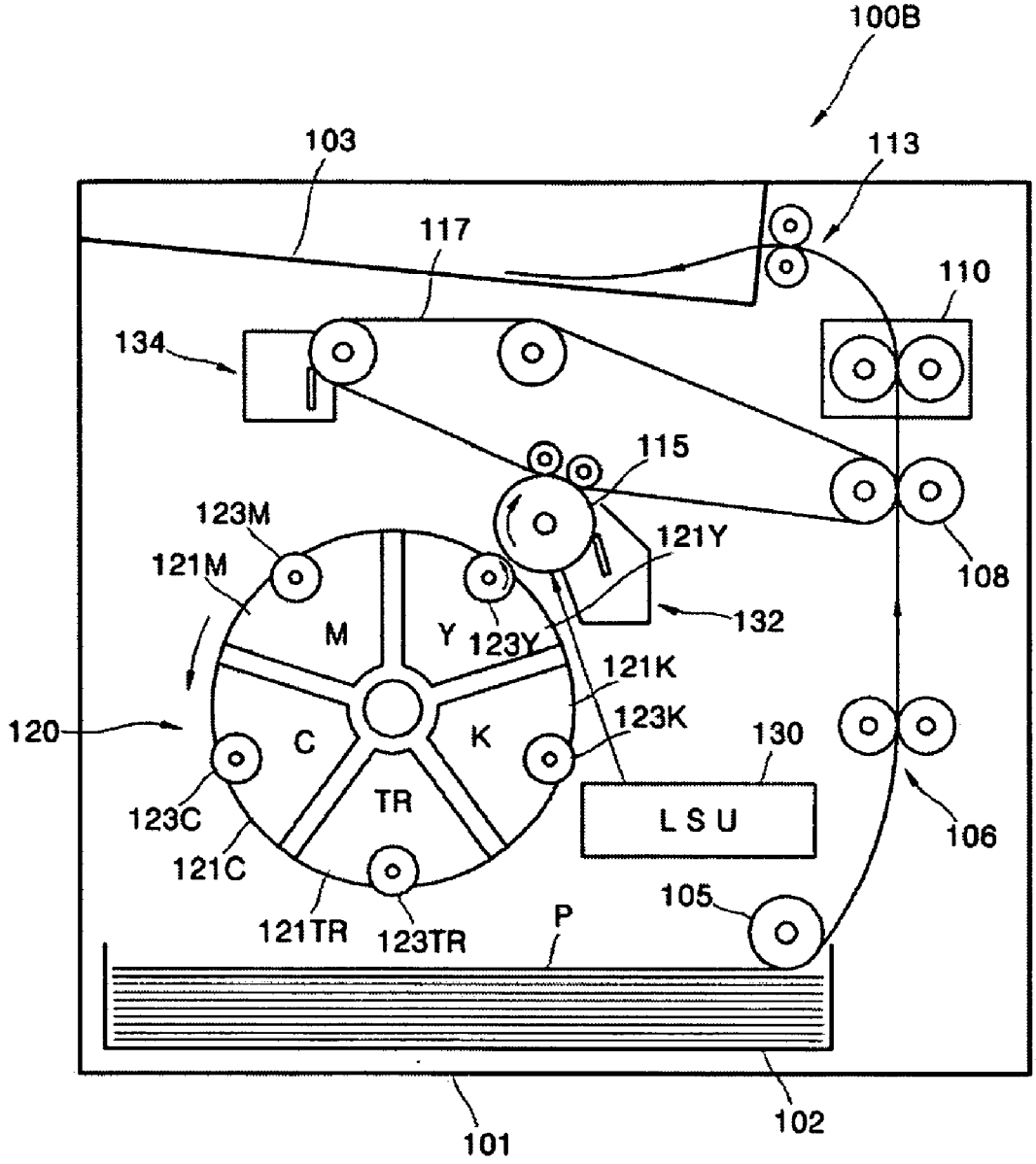
FIG. 4 is a cross sectional view of an electrophotographic image forming apparatus according to a fourth exemplary embodiment of the present invention.
Figure 5:
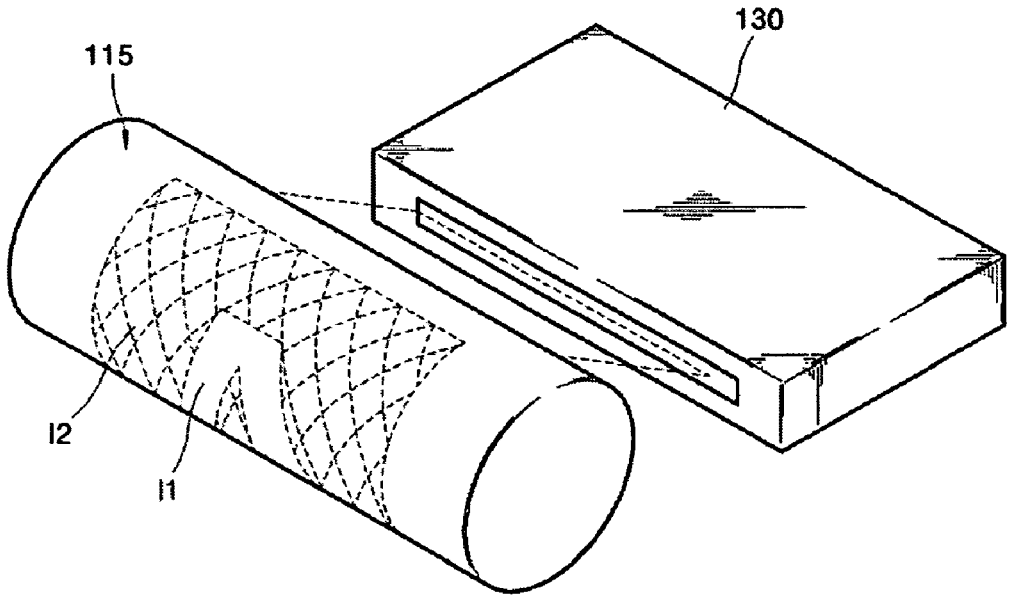
FIG. 5 is a perspective view of a photosensitive medium of FIG. 4 on which a transparent-image electrostatic latent image is formed.

FIG. 4 is a cross sectional view of an electrophotographic image forming apparatus according to a fourth exemplary embodiment of the present invention, and FIG. 5 is a perspective view of a photosensitive medium of FIG. 4 on which a transparent-image electrostatic latent image is formed.

Referring to FIG. 4, the electrophotographic image forming apparatus 100B according to the fourth exemplary embodiment of the present invention is a multi-path type image forming apparatus where an image is transferred to a printing medium P through an intermediate transfer medium 117. The image forming apparatus 100B includes a turret 120 on which five developing units 121 are mounted, a cylindrical photosensitive medium 115, a light scanning unit 130, the intermediate transfer medium 117, and a transfer roller 108 within a case 101 of the electrophotographic image forming apparatus 100B.

The photosensitive medium 115 is a medium constructed by forming a photosensitive layer made of a photo-conductive material disposed on an outer surface of a metal drum by deposition or the like. The light scanning unit 130 is disposed under the photosensitive medium 115 and scans a light beam corresponding to image information on the photosensitive medium 115. An electrostatic latent image is formed on a surface of the photosensitive medium 115 where exposed to the light beam. A laser scanning unit (LSU) using a laser diode is generally employed as the light scanning unit 130.

The five developing units 121C, 121M, 121Y, 121K, and 121TR mounted on the turret 120 contain cyan (C), magenta (M), yellow (Y), black (K) color, and non-colored transparent solid powder toners, respectively. To produce glossy photographic images, the glossy toners are used. A glossy toner can be made by adding a typical colorant, an internal additive material, an outer additive material, and wax to a binding resin. The wax may be a natural wax, a paraffin wax, an ester wax, or the like. As the amount of added wax increases, the glossiness of the toner increases. The wax can be added up to about 5% of the total weight of the toner. In an exemplary embodiment, the wax is about 3% of the total weight of the toner.

The color glossy toners of cyan (C), magenta (M), yellow (Y), and black (B) colors contained in the respective color developing units 121C, 121M, 121Y, and 121K and the transparent glossy toner contained in the transparent developing unit 121TR are charged with a negative (−) polarity. Unlike typical toners, no colorant is added to the transparent glossy toner. At least one of silica, a silica titan oxide, and an aluminum oxide which have a BET surface area of 150 m2/g or more may be added as an outer additive material to the transparent glossy toner.

The four color developing units 121C, 121M, 121Y, and 121K and the transparent developing unit 121TR include respective developing rollers 123C, 123M, 123Y, 123K, and 123TR which apply the toners contained therein to the photosensitive medium 115 to develop respective color images and a transparent image. The turret 120 rotates in a counterclockwise direction and enables the developing units 121C, 121M, 121Y, 121K, and 121TR to sequentially face the photosensitive medium 115 and apply toner to the photosensitive medium 115 to develop the color images and the transparent image.

Although not shown, the developing units 121C, 121M, 121Y, 121K, and 121 TR are provided with toner applying rollers for applying the toners to the developing rollers 123C, 123M, 123Y, 123K, and 123TR, doctor blades for controlling the amounts of the toners applied to the developing roller 123C, 123M, 123Y, 123K, and 123TR, and agitators for agitating the toners so that they do not congeal.

The intermediate transfer medium 117 is a transfer belt which is supported by a plurality of supporting rollers. The intermediate transfer belt circulates and a cyan (C) image, a magenta (M) image, a yellow (Y) image, a black (K) image, and a transparent image are sequentially transferred to the intermediate transfer medium 117 to form a multi-color image. In the multi-color image, both the transparent non-image region as well as the image region where characters, symbols, designs, or the like are represented with predetermined colors are glossy. The length of the intermediate transfer medium 117 is equal to or greater than the length of the printing medium P on which the multi-color image is finally transferred.

The transfer roller 108 faces the intermediate transfer medium 117. While the toners are transferred to the intermediate transfer medium 117, the transfer roller 108 is separated from the intermediate transfer medium 117. Once the toner images are formed on the intermediate transfer medium 117, the transfer roller 108 contacts the intermediate transfer medium 117 to transfer the toner images onto the printing medium P.

A fusing unit 110 fixes the toner image transferred to the printing medium P onto the printing medium P. The fusing unit 110 includes a pair of rollers which are engaged with each other to rotate and a heater for heating the printing medium P. If the printing medium P on which the toner images are transferred passes through the fusing unit 110, the toner images are fixed onto the printing medium P by heat and pressure, so that image printing is completed.

In a lower portion of the image forming apparatus 100B, a paper-feeding cassette 102 in which the printing medium P is contained is detachably inserted in the case 101. The printing medium P contained in the paper-feeding cassette 102 is picked up one by one by a pickup roller 105. A paper-feeding roller 106 feeds the printing medium P picked up by the pickup roller 105 to the transfer roller 108. An ejecting roller 113 ejects the printing medium P from the case 101. The ejected paper is ejected onto a discharge tray 103 disposed on an upper surface of the case 101.

In addition, the image forming apparatus 100B includes a first waste toner cleaner 132 for scraping and removing waste toner which is not transferred to the intermediate transfer medium 117 from the photosensitive medium 115. A second waste toner cleaner 134 scrapes and removes waste toner which is not transferred to the printing medium P from the intermediate transfer medium 117.

In summary, the construction of the electrophotographic image forming apparatus 100B shown in FIG. 4 according to the fourth exemplary embodiment of the present invention is the same as the construction of the electrophotographic image forming apparatus 100A shown in FIG. 1 according to the first exemplary embodiment of the present invention, except that the toner charger 125 is removed from the fourth exemplary embodiment of the present invention.

A photographic image printing method using the electrophotographic image forming apparatus 100B having the aforementioned construction will now be described.

Firstly, if a turret 120 rotates to enable the cyan (C) developing unit 121C to face the photosensitive medium 11, the light scanning unit 130 scans a light beam corresponding to the cyan (C) color image information to the photosensitive medium 115, so that an electrostatic latent image corresponding to the cyan (C) color image is formed on the surface of the photosensitive medium 115. The cyan (C) glossy toner having a negative (−) polarity contained in the cyan developing unit 121C is attached to the electrostatic latent image, so that the cyan (C) color glossy toner image is developed on the photosensitive medium 115, and the toner image is transferred to the intermediate transfer medium 117.

After the cyan (C) color toner image is formed on the intermediate transfer medium 117, the turret 120 rotates by 72° in a counterclockwise direction to enable the magenta developing unit 121M to face the photosensitive medium, and the light scanning unit 130 scans a light beam corresponding to the magenta (M) color image information on the photosensitive medium 115, so that a magenta (M) color-image electrostatic latent image is formed. Therefore, the magenta (M) glossy toner having a negative (−) polarity contained in the magenta developing unit 121M is attached to the electrostatic latent image, so that the magenta (M) color toner image is developed on the photosensitive medium 115, and the toner image is transferred to the intermediate transfer medium 117.

At this time, by appropriately setting the scanning timing of the light beam scanned from the light scanning unit 130 based on the circulating speed of the intermediate transfer medium 117, a distal end of the cyan (C) color toner image previously formed on the intermediate transfer medium 117 and a distal end of the magenta (M) color toner image starting to be transferred from the photosensitive medium 115 to the intermediate transfer medium 117 are accurately aligned with each other.

These operations are repeated for the yellow (Y) and black (K), so that the cyan (C), magenta (M), yellow (Y), and black (K) color toner images are integrated on the intermediate transfer medium 117.

After the black (K) color toner image is transferred to the intermediate transfer medium 117, the turret 120 rotates by 72° in a counterclockwise direction to enable the transparent developing unit 121TR to face the photosensitive medium 115. The light scanning unit 130 generates an electrostatic latent image for forming the transparent image on the surface of the photosensitive medium 115.

Referring to FIG. 5, the transparent-image electrostatic latent image is formed by exposing a non-image region I2 constructed by subtracting an image region I1 constructed by integrating the cyan (C), magenta (M), yellow (Y), and black (K) color-image electrostatic latent images from an exposure-available region of the photosensitive medium 115. The light scanning unit 130 scans the light beam based on a differential signal (that is, a reverse conversion signal of the data signal) which is obtained by subtracting a data signal corresponding to image information constructed by integrating the C, M, Y, and K color image information from a reference signal. Referring to FIG. 8, for example, the non-image region scanned with the light beam for forming the transparent-image electrostatic latent image is an outer boundary region of the design "A". The transparent (TR) glossy toner contained in the transparent developing unit 121TR is attached to the transparent-image electrostatic latent image, so that the glossy transparent toner image is developed on the photosensitive medium 115.

Returning to FIG. 4, the transparent toner image is transferred to the intermediate transfer medium 117. At this time, in order not to overlap the boundary portions of the color toner images previously formed on the intermediate transfer medium 117 with the boundary portion of the transparent toner image, the scanning timing of the light beam scanned from the light scanning unit 130 must be appropriately set based on the circulating speed of the intermediate transfer medium 117.

The toner image formed by integrating the C, M, Y, and K color toner images and the transparent toner image is finally transferred to the printing medium P. More specifically, the printing medium P contained in the paper-feeding cassette 102 is picked up by the pickup roller 105, and fed by the paper-feeding roller 106 to pass between the transfer roller 108 and the intermediate transfer medium 1 17. At this time, by a transfer bias applied to the transfer roller 108, the toner image on the intermediate transfer medium 117 is transferred to the printing medium P. The toner image transferred to the printing medium P passes through the fusing unit 110 and is fixed onto the printing medium P by heat and pressure to form a photographic image. The printing medium P on which the photographic image is printed is ejected by the ejecting roller 113 onto the discharge tray 103.

Figure 6:
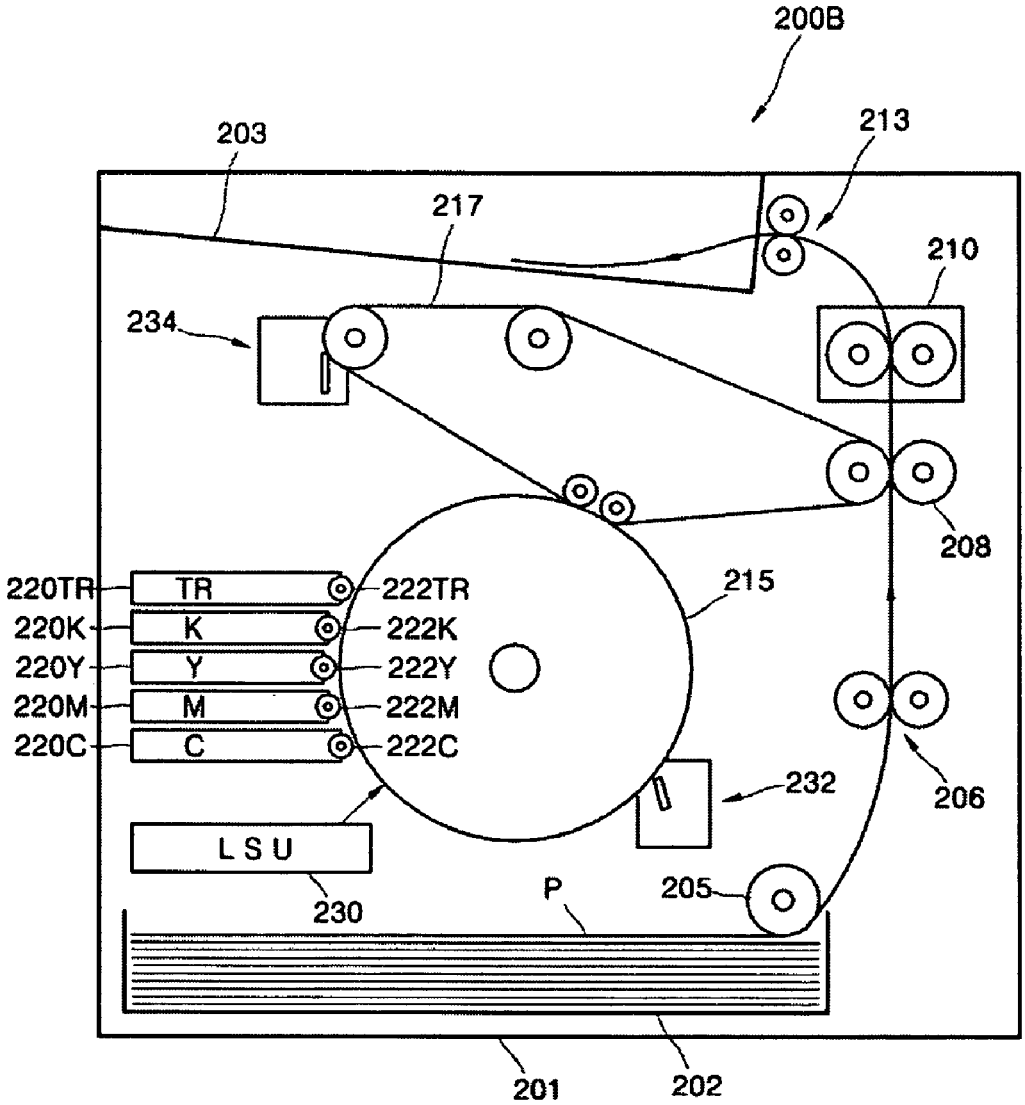
FIG. 6 is a cross sectional view of an electrophotographic image forming apparatus according to a fifth exemplary embodiment of the present invention.

FIG. 6 is a cross sectional view of an electrophotographic image forming apparatus 200B according to a fifth exemplary embodiment of the present invention.

Referring to FIG. 6, similar to the fourth exemplary embodiment, the electrophotographic image forming apparatus 200A according to the second exemplary embodiment of the present invention is a multi-path type image forming apparatus and includes a cylindrical photosensitive medium 215, developing units 220C, 220M, 220Y, 220K, and 220TR stacked on a periphery of the photosensitive medium 215, a light scanning units 230, an intermediate transfer medium 217, and a transfer roller 208 within a case 201 of the electrophotographic image forming apparatus 200A.

The photosensitive medium 215 is a medium constructed with a photosensitive layer made of a photo-conductive material disposed on an outer surface of a metal drum by deposition or the like. The light scanning unit 230 is disposed under the photosensitive medium 215 and scans a light beam corresponding to image information on the photosensitive medium 215. An electrostatic latent image is formed on a surface of the photosensitive medium 215 exposed to the light beam.

The five developing units 221C, 221M, 221Y, 221K, and 221TR contain cyan (C), magenta (M), yellow (Y), black (K) color, and non-colored transparent solid powder toners, respectively. To produce a glossy photographic image, glossy toners are used. In addition, the color glossy toners are charged with a negative (−) polarity, and the transparent glossy toner is charged with a positive (+) polarity. Since the toners in the fifth exemplary embodiment are the same as those of the fourth exemplary embodiment, a detailed description is not repeated.

The four color developing units 220C, 220M, 220Y, and 220K and the transparent developing unit 220TR include developing roller 222C, 222M, 222Y, 222K, and 222TR for applying toners contained therein to the photosensitive medium 215 to develop color images and the transparent image, respectively. The developing units 220C, 220M, 220Y, 220K, and 220TR sequentially approach the photosensitive medium 215 and apply toners thereto to develop the C, M, Y, and K color toner images and the transparent toner image on the outer surface of the photosensitive medium 215. Although not shown, similar to the fourth exemplary embodiment, an applying roller, a doctor blade, and an agitator are provided to each of the developing units 220C, 220M, 220Y, 220K, and 220TR.

The intermediate transfer medium 217 is a transfer belt supported by a plurality of supporting rollers. The color toner images and transparent toner image are transferred onto the intermediate transfer medium 217. The length of the intermediate transfer medium 217 is equal to or greater than that of the printing medium P.

Transfer roller 208 faces the intermediate transfer medium 217. While the toners are transferred to the intermediate transfer medium 217, the transfer roller 208 is separated from the intermediate transfer medium 217. Once the toner images are formed on the intermediate transfer medium 217, the transfer roller 208 contacts the intermediate transfer medium 217 to transfer the toner images onto the printing medium P.

In addition, similar to the image forming apparatus 100B (see FIG. 4) in the fourth exemplary embodiment, the image forming apparatus 200B includes a fusing unit 210 for fixing the toner images transferred to the printing medium P on the printing medium P, a paper-feeding cassette 202 in which the printing medium P is contained, a pickup roller 205 for picking up the printing medium P contained in the paper-feeding cassette 202 one by one, a paper-feeding roller 206 for feeding the printing medium P picked up by the pickup roller 205 to the transfer roller 208, an ejecting roller 213 for ejecting the printing medium P from the case 201, and a discharge tray 203 for receiving the printing medium P ejected by the ejecting roller 213. In addition, the image forming apparatus 200A includes a first waste toner cleaner 232 for scraping and removing waste toner which is not transferred to the intermediate transfer medium 217 from the photosensitive medium 215 and a second waste toner cleaner 234 for scraping and removing waste toner which is not transferred to the printing medium P from the intermediate transfer medium 217.

In summary, the construction of the electrophotographic image forming apparatus 200B shown in FIG. 6 according to the fifth exemplary embodiment of the present invention is the same as the construction of the electrophotographic image forming apparatus 200A shown in FIG. 2 according to the second exemplary embodiment of the present invention, except that the toner charger 125 is removed. A photographic image printing method using the electrophotographic image forming apparatus 200B according to the fifth exemplary embodiment will now be described.

Firstly, the cyan developing unit 220C approaches the photosensitive medium 215, and the light scanning unit 230 scans a light beam corresponding to the cyan (C) color image information to the photosensitive medium 215, so that an electrostatic latent image corresponding to the cyan (C) color image is formed on the surface of the photosensitive medium 215. The cyan (C) glossy toner having a negative (−) polarity contained in the cyan developing unit 220C is attached to the electrostatic latent image, so that the cyan (C) color glossy toner image is developed on the photosensitive medium 215, and the toner image is transferred to the intermediate transfer medium 217.

Once the cyan (C) color toner image is formed on intermediate transfer medium 217, the cyan developing unit 220C is withdrawn, and the magenta developing unit 220M is extended toward the photosensitive medium 215. The light scanning units 230 scans a light beam corresponding to the magenta (M) color image information onto the photosensitive medium 215 to form an electrostatic latent image corresponding to the magenta (M) color image. The magenta (M) glossy toner having a negative (−) polarity contained in the magenta developing unit 220M is attached to the electrostatic latent image, so that the magenta (M) color toner image is developed on the photosensitive medium 215, and the toner image is transferred to the intermediate transfer medium 217.

At this time, by appropriately setting the scanning timing of the light beam scanned from the light scanning unit 230 based on the circulating speed of the intermediate transfer medium 217, a distal end of the cyan (C) color toner image previously formed on the intermediate transfer medium 217 and a distal end of the magnet (M) color toner image starting to be transferred from the photosensitive medium 215 to the intermediate transfer medium 217 are accurately aligned with each other.

These operations are repeated for the yellow (Y) and black (K) images, so that the cyan (C), magenta (M), yellow (Y), and black (K) color toner images are integrated on the intermediate transfer medium 217.

After the black (K) color toner image is transferred to the intermediate transfer medium 217, the black developing unit 220K is withdrawn, and the transparent developing unit 220TR is extended toward the photosensitive medium 215. By the light beam scanned from the light scanning units 230, an electrostatic latent image for forming the transparent image is formed on the surface of the photosensitive medium 215.

The transparent-image electrostatic latent image is formed by exposing a non-image region formed by subtracting an image region constructed by integrating the cyan (C), magenta (M), yellow (Y), and black (K) color-image electrostatic latent images from an exposure-available region of the photosensitive medium 215. The light scanning unit 230 scans the light beam based on a reverse conversion signal of the data signal corresponding to image information constructed by integrating the C, M, Y, and K color image information. The transparent (TR) glossy toner having a negative (−) polarity contained in the transparent developing unit 220TR is attached to the transparent-image electrostatic latent image, so that the glossy transparent toner image is developed on the photosensitive medium 215. The transparent toner image is transferred to the intermediate transfer medium 217. At this time, in order not to overlap the boundary portions of the color toner images previously formed on the intermediate transfer medium 217 with the boundary portion of the transparent toner image, the scanning timing of the light beam scanned from the light scanning unit 230 must be appropriately set based on the circulating speed of the intermediate transfer medium 217.

The toner image formed by integrating the C, M, Y, and K color toner images and the transparent toner image is finally transferred to the printing medium P which passes between the transfer roller 208 and the intermediate transfer medium 217 and fixed onto the printing medium P by the fusing unit 210, so that a photographic image is formed. The printing medium P on which the photographic image is printed is ejected by the ejecting roller 213 onto the discharge tray 203.

Figure 7:
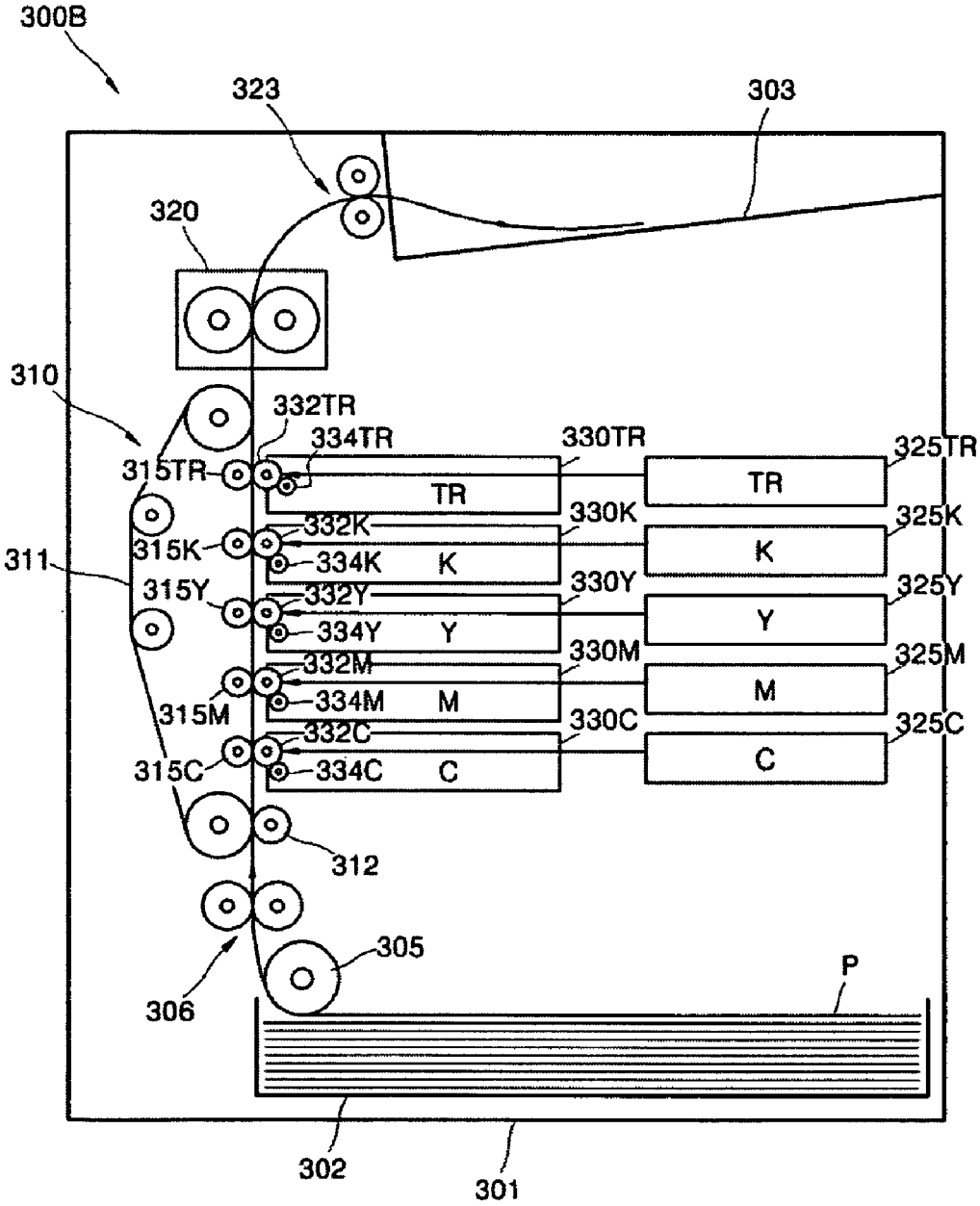
FIG. 7 is a cross sectional view of an electrophotographic image forming apparatus according to a sixth exemplary embodiment of the present invention.

FIG. 7 is a cross sectional view of an electrophotographic image forming apparatus 300B according to a sixth exemplary embodiment of the present invention.

Referring to FIG. 7, the electrophotographic image forming apparatus 300B is a single-path type image forming apparatus where an image is directly transferred to a printing medium P and includes five developing units 330C, 330M, 330Y, 330K, and 330TR, five light scanning units 325C, 325M, 325Y, 325K, and 325TR, and a transferring unit 310 within a case 301 of the electrophotographic image forming apparatus 300A.

The five developing units 330C, 330M, 330Y, 330K, and 330TR contain cyan (C), magenta (M), yellow (Y), black (K) color, and non-colored transparent solid powder toners, respectively. To produce a glossy photographic image, glossy toners are used. The four types of color glossy toners are charged with a negative (−) polarity, and the transparent glossy toner is charged with a positive (+) polarity. Since the toners in the third exemplary embodiment are the same as those of the first exemplary embodiment, a detailed description is not repeated.

The four color developing units 330C, 330M, 330Y, and 330K and the transparent developing unit 330TR include photosensitive media 332C, 332M, 332Y, 332K, and 332TR and developing rollers 334C, 334M, 334Y, 334K, and 334TR. The developing rollers 334C, 334M, 334Y, 334K, and 334TR apply toners contained in the developing units 330C, 330M, 330Y, 330K, and 330TR to the photosensitive media 332C, 332M, 332Y, 332K, and 332TR to form C, M, Y, and K color images and a transparent image on surfaces thereof. Although not shown, similar to the first exemplary embodiment, an applying roller, a doctor blade, and an agitator are provided to each of the developing units 330C, 330M, 330Y, 330K, and 330TR.

Five light scanning units 325C, 325M, 325Y, 325K, and 325TR corresponding to the five developing units 330C, 330M, 330Y, 330K, and 330TR scan light beams corresponding to image information to the photosensitive media 332C, 332M, 332Y, 332K, and 332TR, respectively. Electrostatic latent images are formed on surfaces of the photosensitive media 332C, 332M, 332Y, 332K, and 332TR exposed to the light beams.

The transferring unit 310 includes a conveying belt 311 which is supported by a plurality of supporting rollers and an attaching roller 312. The conveying belt 311 circulates upwards and downwards and the attaching roller 312 induces static electricity to attach the printing medium P to the conveying belt 311 so that the printing medium is transferred upwardly. In addition, the transferring unit 310 includes five transfer rollers 315C, 315M, 315Y, 315K, and 315TR which face the photosensitive media 332C, 332M, 332Y, 332K, and 332TR of the developing units 330C, 330M, 330Y, 330K, and 330TR with the conveying belt 311 interposed therebetween.

In addition, similar to the image forming apparatus lOOB according to the fourth exemplary embodiment (see FIG. 4), the image forming apparatus 300B includes a fusing unit 320 for fixing the toner images transferred to the printing medium P on the printing medium P by heat and pressure, a paper-feeding cassette 302 in which the printing medium is contained, a pickup roller 305 for picking up the printing medium P contained in the paper-feeding cassette 302 one by one, a paper-feeding roller 306 for feeding the picked-up printing medium P, an ejecting roller 323 for ejecting the printing medium P on which an image is printed from the case 301, and a discharge tray 303 for receiving the printing medium P ejected from the case 301.

In summary, the construction of the electrophotographic image forming apparatus 300B shown in FIG. 7 according to the sixth exemplary embodiment of the present invention is the same as the construction of the electrophotographic image forming apparatus 300A shown in FIG. 3 according to the third exemplary embodiment of the present invention, except that the toner charger 335 is removed. A photographic image printing method using the electrophotographic image forming apparatus 300B having the aforementioned construction will now be described.

The five light scanning units 325C, 325M, 325Y, 325K, and 325TR scan light beams to the photosensitive media 332C, 332M, 332Y, 332K, and 332TR of the developing units 330C, 330M, 330Y, 330K, and 330TR, so that electrostatic latent images are formed on the photosensitive media 332C, 332M, 332Y, 332K, and 332TR. More specifically, the light scanning units 325C, 325M, 325Y, and 325K corresponding to the color developing units 330C, 330M, 330Y, and 330K scan light beams corresponding to C, M, Y, and K color image information to form C, M, Y, and K color-image electrostatic latent images on surfaces of the photosensitive media 332C, 332M, 332Y, and 332K. The light scanning unit 325TR corresponding to the transparent developing unit 330TR scans a light beam based on image information constructed by integrating the C, M, Y, and K color image information, so that the transparent-image electrostatic latent image is formed on the photosensitive medium 332TR by exposing the image region constructed by integrating the C, M, Y, and K color-image electrostatic latent image.

The light scanning unit 325TR corresponding to the transparent developing unit 330TR scans a light beam based on a reverse-conversion signal of a data signal corresponding to image information constructed by integrating the C, M, Y, and K color image information, so that the transparent-image electrostatic latent image is formed on only the non-image region excluding an image region constructed by integrating the C, M, Y, and K color-image electrostatic latent image from an exposure-available region of a surface of the photosensitive medium 332TR.

The color glossy toners having a negative (−) polarity contained in the color developing units 330C, 330M, 330Y, and 330K are attached on the C, M, Y, and K color-image electrostatic latent images. Then, the glossy cyan (C), magenta (M), yellow (Y), black (K) color toner images are developed on the photosensitive media 332C, 332M, 332Y, and 332K. The transparent glossy toner having a negative (−) polarity contained in the transparent developing unit 330TR is attached to the transparent-image electrostatic latent image, so that the glossy transparent toner image is developed on the surface of the photosensitive medium 332TR.

The printing medium P is picked up from the paper-feeding cassette 302 by the pickup roller 305 and fed by the paper-feeding roller 306. Then, due to static electricity induced by the attaching roller 312, the printing medium P is attached on the conveying belt 311 and is conveyed at the same speed as the circulating speed of the conveying belt 311.

As the printing medium P attached on the conveying belt 311 is conveyed upwardly, a transfer bias is applied to the transfer rollers 315C, 315M, 315Y, 315K, and 315TR, so that the C, M, Y, and K color toner images and the transparent toner image are sequentially transferred to the printing medium P. The scanning timing of the light beams scanned from the light scanning units 325TR is set appropriately based on the circulating speed of the conveying belt 311 so that the color toner images and the transparent toner image are registered.

The toner image constructed by integrating the C, M, Y, and K color toner images and the transparent toner image is fixed onto the printing medium P by the fusing unit 320, so that the photographic image is formed. The printing image P on which the photographic image is printed is ejected by the ejecting roller 323 onto the discharge tray 303.

Characteristics of the photographic images printed by the image forming apparatuses 100A, 200A, 300A, 100B, 200B, and 300B according to the first to sixth exemplary embodiments will now be described.

Figure 9:
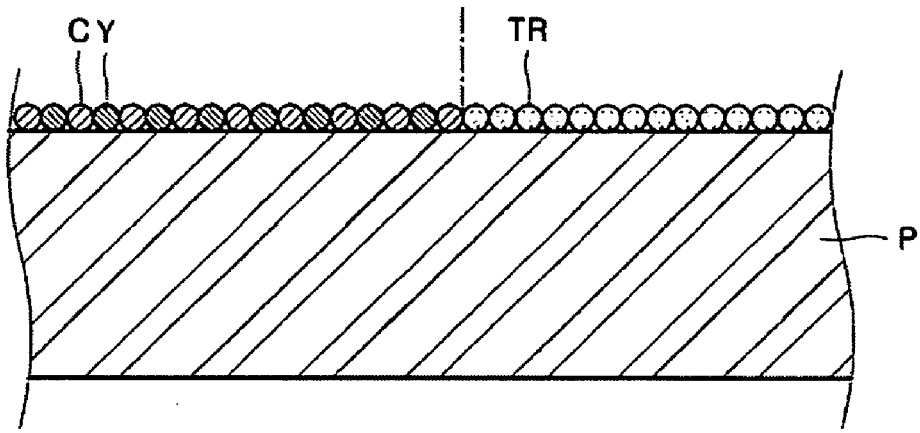
FIG. 9 is a partially enlarged cross sectional view of the printing medium of FIG. 8.

FIG. 8 is a plan view of an example of a printing medium on which an image is printed with an electrophotographic image forming apparatus according to the present invention, and FIG. 9 is a partially enlarged cross sectional view of the printing medium of FIG. 8.

FIG. 8 illustrates a printing medium P on which a photographic image of a design of character "A" is printed. An image region defined as an inner-boundary region of the design of character "A" is green (G), and a non-image region defined as an outer-boundary region of the design of character "A" is the color of the printing medium P. In terms of glossiness of the entire printed surface, the printing medium P shows a feeling similar to a photographic image printed on photographic paper.

Referring to FIG. 9, in the printing medium P, the thickness of the toner distributed on the image region and the thickness of the toner distributed on the non-image region are uniform and equal to each other. In the non-image region, the transparent TR glossy toner is distributed, and in the image region, the cyan (C) and yellow (Y) glossy toners are alternately distributed, so that the printing medium P shows green (G) color. The transparent TR glossy toner does not overlap with the cyan (C) and yellow (Y) glossy toners of the image region but instead is distributed in the non-image region.

According to an electrophotographic image forming apparatus and a method of printing a photographic image, it is possible to print a glossy image on a non-image region as well as an image region of a printing medium.

In addition, the thicknesses of glossy toners distributed in the image region and the non-image region of the printing medium are uniform, differences of glossiness are not shown over the entire printing surface, and images can be printed without unevenness caused by differences of thicknesses of the toners.

In addition, according to an electrophotographic image forming apparatuses of the fourth to sixth exemplary embodiments, the polarities of the color glossy toners and the transparent glossy toner are equal to each other, so that it is possible to easily manufacture the transparent glossy toner and simplify the construction of the electrophotographic image forming apparatuses.

While the present invention has been particularly shown and described with reference to certain exemplary embodiments thereof, it will be understood by those skilled in the art that various changes in form and details may be made therein without departing from the spirit and scope of the present invention. For example, the present invention may be applied to an electrophotographic image forming apparatus for printing only a mono-color photographic image. Therefore, the scope of the present invention is defined by the appended claims.

What is claimed is:

1. An electrophotographic image forming apparatus comprising:

a photosensitive medium comprising a surface on which a color-image electrostatic latent image and a transparent-image electrostatic latent image are formed;

at least one color developing unit for containing a color glossy toner charged with a polarity and for developing a color image on the surface of the photosensitive medium by applying the color glossy toner to the color-image electrostatic latent image;

a transparent developing unit for containing a transparent glossy toner charged with a polarity different from the polarity of the color glossy toner and for developing a transparent image on the surface of the photosensitive medium by applying the transparent glossy toner on an external region of the transparent-image electrostatic latent image; and an intermediate transfer medium on which the color image and the transparent image are sequentially transferred.

2. The electrophotographic image forming apparatus according to claim 1, wherein the color image and the transparent image are transferred to the intermediate transfer medium without overlapping.

3. The electrophotographic image forming apparatus according to claim 1, further comprising a toner charger for charging the transparent glossy toner image developed on the surface of the photosensitive medium with a polarity which is the same as the polarity of the color glossy toner.

4. The electrophotographic image forming apparatus according to claim 3, wherein the toner charger comprises a corotron charger comprising a corona wire to charge the transparent glossy toner without contacting the toner.

5. The electrophotographic image forming apparatus according to claim 1, further comprising a plurality of color developing units for containing different color glossy toners for producing a multi-color image constructed with a plurality of colors, wherein a plurality of different color images and the transparent image are sequentially developed on the surface of the photosensitive medium, and wherein the transparent-image electrostatic latent image is formed on the surface of the photosensitive medium by exposing an image region constructed by integrating the plurality of different color-image electrostatic latent images.

6. The electrophotographic image forming apparatus according to claim 5, wherein the plurality of color developing units comprise a cyan developing unit for containing a cyan (C) color glossy toner, a magenta developing unit for containing a magenta (M) color glossy toner, a yellow developing unit for containing a yellow (Y) color glossy toner, and a black developing unit for containing a black (K) color glossy toner.

7. The electrophotographic image forming apparatus according to claim 5, wherein the plurality of color developing units and the transparent developing unit are mounted on a rotating turret, and wherein the developing units sequentially face the photosensitive medium by rotation of the turret to supply toners on the surface of the photosensitive medium.

8. The electrophotographic image forming apparatus according to claim 5, wherein the plurality of color developing units and the transparent developing unit are disposed on a periphery of the photosensitive medium, and wherein the developing units sequentially approach the-photosensitive medium to supply toners to the surface of the photosensitive medium.

9. The electrophotographic image forming apparatus according to claim 1, wherein the transparent glossy toner is developed as the transparent image in a charged state of a positive (+) polarity, and wherein the color glossy toner is developed as the color image in a charged state of a negative (−) polarity.

* * * * *